US008955641B2

(12) United States Patent
Abram et al.

(10) Patent No.: US 8,955,641 B2
(45) Date of Patent: Feb. 17, 2015

(54) PASSIVE VALVE AND RESONATOR ASSEMBLY FOR VEHICLE EXHAUST SYSTEM

(71) Applicant: Emcon Technologies, LLC, Columbus, IN (US)

(72) Inventors: Kwin Abram, Columbus, IN (US); Ivan Arbuckle, Columbus, IN (US); Kamilla Iskenderova, Columbus, IN (US); James Egan, Indianapolis, IN (US); Dennis Shaw, Columbus, IN (US)

(73) Assignee: Faurecia Emissions Control Technologies, USA, LLC, Columbus, IN (US)

( * ) Notice: Subject to any disclaimer, the term of this patent is extended or adjusted under 35 U.S.C. 154(b) by 15 days.

(21) Appl. No.: 13/852,230

(22) Filed: Mar. 28, 2013

(65) Prior Publication Data

US 2013/0213731 A1 Aug. 22, 2013

Related U.S. Application Data

(63) Continuation of application No. 11/964,062, filed on Dec. 26, 2007, now abandoned.

(60) Provisional application No. 60/989,508, filed on Nov. 21, 2007.

(51) Int. Cl.

| | |
|---|---|
| ***F01N 1/04*** | (2006.01) |
| ***F01N 1/02*** | (2006.01) |
| ***F01N 13/08*** | (2010.01) |
| ***F02D 9/04*** | (2006.01) |
| ***F02D 9/10*** | (2006.01) |

(52) U.S. Cl.
CPC *F01N 1/02* (2013.01); *F01N 13/08* (2013.01); *F02D 9/04* (2013.01); *F02D 9/1025* (2013.01); *F02D 9/1065* (2013.01); *F01N 2240/36* (2013.01); *F01N 2260/06* (2013.01)
USPC ..... 181/254; 181/232

(58) Field of Classification Search
USPC ..... 181/211, 212, 232, 241, 252, 254, 256
See application file for complete search history.

(56) References Cited

U.S. PATENT DOCUMENTS

| | | | | |
|---|---|---|---|---|
| 4,239,091 A | | 12/1980 | Nagrao | |
| 4,501,341 A | * | 2/1985 | Jones | 181/250 |
| 5,245,140 A | | 9/1993 | Wu | |

(Continued)

FOREIGN PATENT DOCUMENTS

| | | | | |
|---|---|---|---|---|
| JP | 06280542 A | * | 10/1994 | F01N 1/02 |
| JP | 2000257418 A | * | 9/2000 | F01N 3/24 |

OTHER PUBLICATIONS

English translation of JP 2000257418 A, accessed Nov. 4, 2008 from JPO website.*

*Primary Examiner* — Jeremy Luks
(74) *Attorney, Agent, or Firm* — Carlson, Gaskey & Olds, PC

(57) ABSTRACT

An exhaust system includes first and second exhaust components with an inter-pipe that fluidly connects an outlet of the first exhaust component to an inlet of the second exhaust component. A passive valve is mounted within the inter-pipe. The second exhaust component defines an internal cavity that is at least partially packed with a high frequency absorption material and cooperates with the passive valve to effectively attenuate low and high frequency noise.

27 Claims, 2 Drawing Sheets

(56) References Cited

U.S. PATENT DOCUMENTS

| | | | | |
|---|---|---|---|---|
| 5,655,367 | A | 8/1997 | Peube et al. | |
| 5,726,397 | A | 3/1998 | Mukai et al. | |
| 5,801,343 | A | 9/1998 | Suzuki et al. | |
| 6,446,750 | B1 * | 9/2002 | Lewin | 181/256 |
| 6,467,571 | B2 | 10/2002 | Nakagawa | |
| 6,581,721 | B2 | 6/2003 | Nagai et al. | |
| 6,755,279 | B2 | 6/2004 | Kaneko et al. | |
| 2002/0033302 | A1 | 3/2002 | Kaneko et al. | |
| 2002/0114486 | A1 | 8/2002 | Fukawatase et al. | |
| 2004/0262077 | A1 * | 12/2004 | Huff et al. | 181/250 |

* cited by examiner

PASSIVE VALVE AND RESONATOR ASSEMBLY FOR VEHICLE EXHAUST SYSTEM

RELATED APPLICATIONS

This application is a continuation of application Ser. No. 11/964,062, which claims priority to provisional application Ser. No. 60/989,508 filed on Nov. 21, 2007.

TECHNICAL FIELD

The subject invention relates to a passive valve and resonator configuration in a vehicle exhaust system, and more particularly relates to a passive valve in combination with a packed resonator.

BACKGROUND OF THE INVENTION

Exhaust systems are widely known and used with combustion engines. Typically, an exhaust system includes exhaust tubes that convey hot exhaust gases from the engine to other exhaust system components, such as mufflers, resonators, etc. Mufflers and resonators include acoustic chambers that cancel out sound waves carried by the exhaust gases. Although effective, these components are often relatively large in size and provide limited nose attenuation.

Passive valves have been used in a muffler to provide further noise attenuation. However, the proposed valves have numerous drawbacks that limit their widespread use in a variety of applications. One disadvantage with passive valves is their limited use in high temperature conditions. Another disadvantage with known passive valve configurations is that these valves do not effectively attenuate low frequency noise. Further, additional challenges are presented when these types of valves are used in exhaust systems with multiple mufflers.

Attempts have been made to improve low frequency noise attenuation without using passive valves by either increasing muffler volume or increasing backpressure. Increasing muffler volume is disadvantageous from a cost, material, and packaging space perspective. Increasing backpressure can adversely affect engine power. Thus, solutions are needed to more effectively incorporate passive valves within an overall exhaust system.

Still other attempts have been made to use the passive valve in the exhaust system at a location outside of a muffler. For example, the passive valve has been used within an exhaust pipe with a by-pass configuration. The passive valve includes a flapper valve body or vane that is positioned within the exhaust pipe, with the vane being pivotable between an open position and a closed position. The passive valve is spring biased toward the closed position, and when exhaust gas pressure is sufficient to overcome this spring bias, the vane is pivoted toward the open position. In by-pass configurations, the vane provides 100% coverage, i.e. complete blockage, of the exhaust component when in the closed position. When closed, exhaust gases can flow outside of the exhaust pipe that houses the vane via a by-pass pipe that is connected to the exhaust pipe at locations upstream and downstream of the vane. The vane is generally configured such that, during pivotal movement, edges of the vane do not contact inner surfaces of the exhaust component. While use of such a valve improves low frequency noise attenuation, there is additional flow noise caused by turbulence generated at edges of the vane. Thus, while using the passive valve outside of the muffler has addressed certain problems, it has raised additional noise challenges that need to be addressed.

Therefore, there is a need to provide a passive valve arrangement that can effectively attenuate low frequency noises while also addressing additional noise issues introduced by the use of the passive valve itself. This invention addresses those needs while avoiding the shortcomings and drawbacks of the prior art.

SUMMARY OF THE INVENTION

A vehicle exhaust system includes first and second exhaust components with an inter-pipe that fluidly connects an outlet of the first exhaust component to an inlet of the second exhaust component. A passive valve is mounted within the inter-pipe. The second exhaust component defines an internal cavity that is at least partially packed with a high frequency absorption material. This packed configuration cooperates with the passive valve to effectively attenuate low and high frequency noise.

In one example, the first and the second exhaust components comprise first and second mufflers or resonators and the inter-pipe comprises a sole exhaust gas flow path between the first outlet and the second inlet.

In one example, the first exhaust component has a first inlet and a first outlet, and the second exhaust component defines an internal cavity that has a second inlet and a second outlet. The second inlet and the second outlet cooperate to define an internal flow path through the second exhaust component. The internal flow path occupies a portion of the internal cavity leaving a remaining portion. The remaining portion of the internal cavity is completely packed with a high frequency absorption material. The inter-pipe connects the first outlet with the second inlet, and the passive valve is mounted within the inter-pipe.

In one example, the second exhaust component includes a pipe that connects the second inlet to the second output to define the internal flow path. The pipe is defined by a pipe diameter and the passive valve is mounted within the inter-pipe at a specified distance from the second inlet of the second exhaust component. In one example, this specified distance is a distance that is at least four times the pipe diameter of the internal flow path.

In one example, the pipe includes a perforated section and the high frequency absorption material is positioned within the internal cavity to contact at least a portion of the perforated section. In one example, the high frequency absorption material contacts an entire length of the perforated section.

The above-described combination of a passive valve and an associated packed muffler cooperate to effectively attenuate low and high frequency noises. The use of the passive valve within a non-bypass inter-pipe provides very effective low frequency noise attenuation while the use of the packed rear positioned muffler addresses noise issues created due to the passive valve location and configuration. These and other features of the present invention can be best understood from the following specification and drawings, the following of which is a brief description.

DETAILED DESCRIPTION

Figure 1:
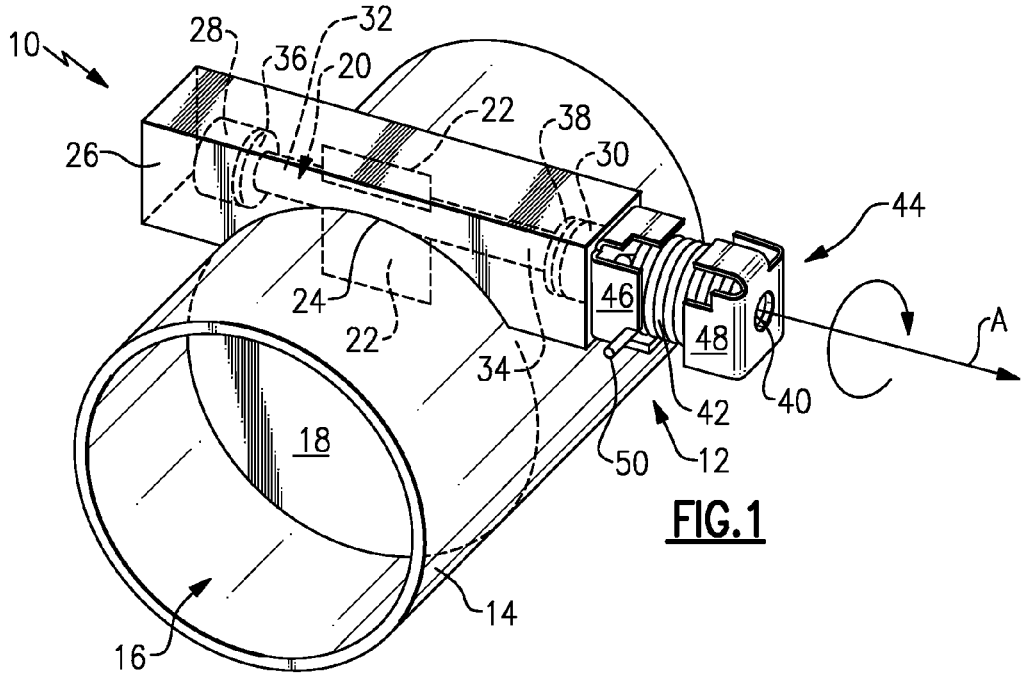
FIG. 1 shows a perspective view of an exhaust pipe component and passive assembly.

As shown in FIG. 1, an exhaust component, such as an exhaust tube or pipe 10 includes an exhaust throttling valve, referred to as a passive valve assembly 12. The passive valve assembly 12 is movable between an open position where there is minimal blockage of an exhaust gas flow path 16 and a closed position where a substantial portion of the exhaust gas flow path 16 is blocked. The passive valve assembly 12 is resiliently biased toward the closed position and is moved toward the open position when exhaust gas flow generates a pressure sufficient enough to overcome the biasing force.

In the example shown, the exhaust pipe 10 comprises a single tube body 14 that defines the exhaust gas flow path 16. The passive valve assembly 12 includes a valve body or vane 18 that blocks a portion of the exhaust gas flow path 16 when in the closed position. As discussed above, the vane 18 is pivoted toward the open position to minimize blockage of the exhaust gas flow path 16 in response to pressure exerted against the vane 18 by exhaust gases.

In one example, the vane 18 is fixed to a shaft 20 with a tang or bracket 22. A slot 24 is formed within an outer surface of the tube body 14. A housing 26, shown in this example as a square metal structure, is received within this slot 24 and is welded to the tube body 14. Other housing configurations could also be used. The shaft 20 is rotatably supported within the housing 26 by first 28 and second 30 bushings or bearings. In the example shown, the bracket 22 comprises a piece of sheet metal that has one portion welded to the shaft 20 and another portion that extends outwardly from the housing 26 and is welded to the vane 18. Thus, the vane 18 and the shaft 20 pivot together about an axis A that is defined by the shaft 20. The bracket 22 is just one example of how the shaft 20 can be attached to the vane 18, it should be understood that other attachment mechanisms could also be used.

The first bushing 28 is positioned generally at a first shaft end 32. The first bushing 28 comprises a sealed interface for the first shaft end 32. The shaft 20 includes a shaft body 34 that has a first collar 36 and a second collar 38. The first bushing 28 includes a first bore that receives the first shaft end 32 such that the first collar 36 abuts directly against an end face of the first bushing 28 to provide a sealed interface. As such, exhaust gases cannot leak out of the first bushing 28 along a path between the shaft 20 and first bushing 28.

The second bushing 30 includes a second bore through which the shaft body 34 extends to a second shaft end 40. The second collar 38 is located axially inboard of the second bushing 30. The shaft 20 extends through the second bore to an axially outboard position relative to the second bushing 30. A resilient member, such as a spring 42 for example, is coupled to the second shaft end 40 with a spring retainer 44. The spring retainer 44 includes a first retainer piece 46 that is fixed to the housing 26 and a second retainer piece 48 that is fixed to the second shaft end 40. One spring end 50 is associated with housing 26 via the first retainer piece 46 and a second spring end (not viewable in FIG. 1 due to the spring retainer 44) is associated with the shaft 20 via the second retainer piece 48.

Figure 2:
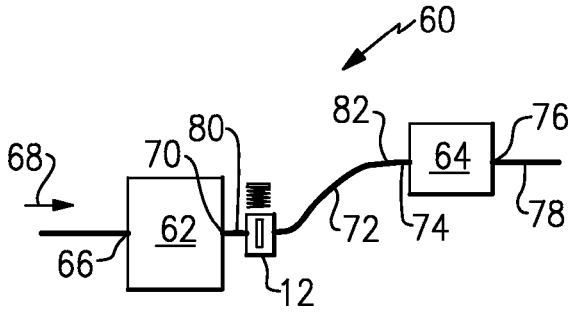
FIG. 2 shows one example of a passive valve in a vehicle exhaust system.

The passive valve assembly 12 is advantageously positioned within a vehicle exhaust system at a certain positional relationship to other exhaust components to provide a significant acoustic advantage for overall noise attenuation. FIG. 2 schematically shows a vehicle exhaust system 60 that includes at least one first resonator or muffler 62 and at least one second resonator or muffler 64. The first muffler 62 has an inlet 66 that receives exhaust gas flow from an engine as indicated at 68. The first muffler 62 includes an outlet 70 that directs exhaust gases to an inter-pipe 72.

The inter-pipe 72 fluidly connects the outlet 70 of the first muffler to an inlet 74 of the second muffler 64. The second muffler 64 includes an outlet 76 that is fluidly connected to a tailpipe 78. The inter-pipe 72 can be a single tube or can be comprised of multiple tube portions connected together to form a single tube between the first 62 and second 64 mufflers. Similarly, the tailpipe 78 can be a single tube or can be comprised of multiple tube portions connected together to form a single flow gas exit from the exhaust system 60.

The inter-pipe 72 forms the sole exhaust gas flow path between the first 62 and second 64 mufflers. In other words, there is no by-pass flow option within the fluid connections between the first 62 and second 64 mufflers. As such, the inter-pipe 72 extends from a first end 80 to a second end 82 to define an overall pipe length referred to as a developed length of the pipe. The first 80 and second 82 ends need not be co-axial, thus the developed length of the pipe can be comprised of a single straight section of pipe or can be comprised of a combination of straight and curved sections of pipe having their lengths added together.

The passive valve assembly 12 is mounted external to the first 62 and second mufflers 64 and within the inter-pipe 72. The passive valve assembly 12 is positioned within the inter-pipe 72 between the first 80 and second 82 ends at a specified location in relation to the second muffler 64. This will be discussed in greater detail below.

Figure 3:
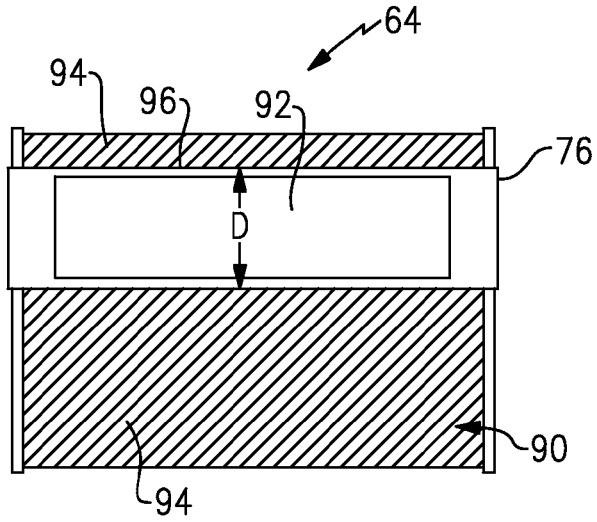
FIG. 3 shows a cross-sectional view of a rearmost exhaust component from FIG. 2.

FIG. 3 shows a cross-sectional view of the second muffler 64. The second muffler 64 defines an internal cavity 90 that has a single inlet 74 and a single outlet 76. The inlet 74 and outlet 76 cooperate to define the sole flow path 92 within the second muffler 64. This flow path 92 occupies a specified portion of the internal cavity 90 leaving a remaining portion that is not occupied by the flow path 92. This remaining portion is packed with a high frequency absorption material 94. In one example a fiber-based material is used, however, any suitable material for attenuating high frequency noise can be used.

In the example shown, the sole flow path 92 is contained within a pipe body 96 that extends from the inlet 74 to the outlet 76, and the high frequency absorption material 94 completely fills the internal cavity 90 to completely surround the pipe body 96. This completely packed configuration is the most common configuration and is the most efficient configuration from an assembly and manufacture perspective.

Figure 4:
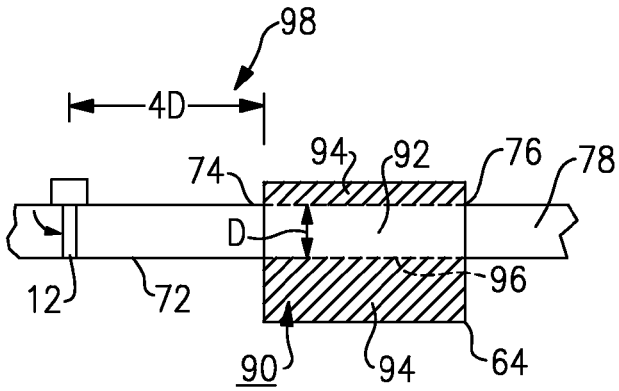
FIG. 4 shows a schematic view of a mounting location of the passive valve in relation to the exhaust component of FIG. 3.

As shown in FIG. 4, the passive valve assembly 12 is mounted within the inter-pipe 72 at a specified location relative to the inlet 74 of the second muffler 64 as indicated at 98. The pipe body 96 is defined by a pipe diameter D. This pipe diameter D can vary depending upon the type of vehicle application and/or other exhaust system characteristics. The passive valve assembly 12 is positioned at a distance that is at least four times the pipe diameter D that defines the flow path 92. By locating the passive valve assembly 12 in such a relation to the inlet 74 of the packed second muffler 64, absorption of flow noise is maximized due to distances involved in generation of flow noise from a geometric step change.

Figure 5:
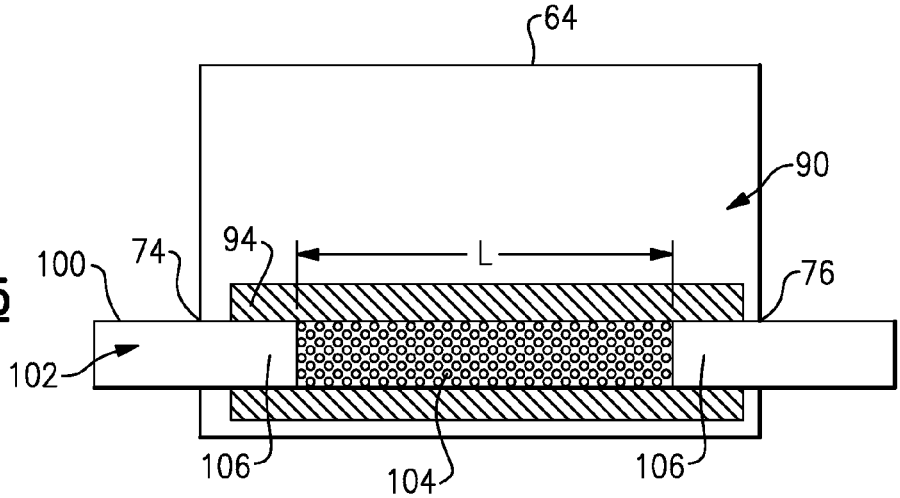
FIG. 5 is a schematic view of one example of a packed exhaust component with a perforated pipe.

In another example shown in FIG. 5, a pipe 100 extends from the inlet 74 to the outlet 76 to define a sole flow path 102. The pipe 100 includes a perforated section 104. The perforated section 104 is positioned within the internal cavity 90 and extends along a portion of an overall length of the pipe 100. As such, a length L of the perforated section 104 is less than the overall length of the pipe 100. The perforated section 104 at least partially extends about an outer circumference of the pipe 100, and in the example shown, extends entirely about the outer circumference of the pipe 100.

The high frequency absorption material 94 is positioned with the internal cavity 90 to contact at least a portion of the perforated section 104 to provide a packed configuration. In the example shown, the high frequency absorption material 94 is positioned to contact the entire length L of the perforated section 104. The high frequency absorption material 94 can comprise material that is packed around the pipe to provide this contact, or the high frequency absorption material 94 can comprise a mat that is wrapped around the perforated section 104.

In the example shown in FIG. 5, the high frequency absorption material 94 also contacts the pipe 100 along non-perforated sections 106. Further, the pipe 100 can also include sections within the internal cavity 90 that are not in contact with high frequency absorption material 94. However, as described above, in each example the high frequency absorption material 94 does contact the entire length L of the perforated section 104 to provide the most effective attenuation of high frequency noise.

Figure 6:
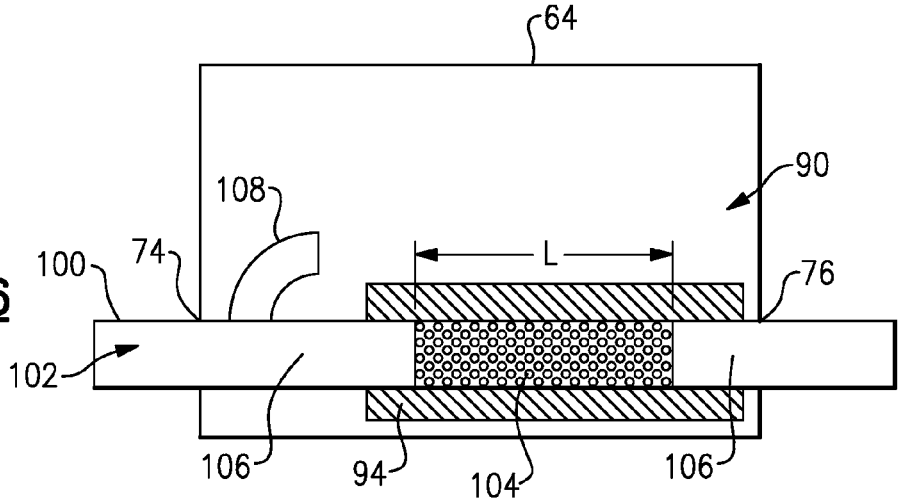
FIG. 6 is a schematic view of another example of a packed exhaust component with a tuning pipe.

In the example shown in FIG. 6, a tuning tube 108 is connected to the pipe 100 at one of the non-perforated sections 106 to provide additional noise attenuation. In this example, the high frequency absorption material 94 is not at a location of the pipe 100 that is contact with high frequency absorption material 94. However, high frequency absorption material 94 could also be used on the pipe 100 at the tuning tube location. Further, the tuning tube 108 could also be used in the configuration shown in FIGS. 2-4.

For the configurations set forth in FIGS. 5 and 6, the passive valve assembly 12 is mounted within the inter-pipe 72 at a specified location relative to the inlet 74 of the second muffler 64 as described above in the examples of FIGS. 2-4. Also, the pipe body 96 shown in FIGS. 3 and 4 could include a perforated section in combination with a completely packed internal cavity.

The use of a packed high frequency muffler downstream of a throttling, spring-biased passive valve provides an effective configuration for attenuating noise. The passive valve assembly 12, which is effective for attenuating low frequency noises, cooperates with the packed muffler, which is effective for attenuating high frequency noise, to provide an exhaust system with significantly improved noise attenuation capability.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A vehicle exhaust system comprising:

a first resonator having a first inlet and a first outlet;

a second resonator positioned downstream of the first resonator, wherein the second resonator has a housing that extends from a first housing end to second housing end to define a housing center axis, and wherein the housing defines a single chamber with an internal cavity having a second inlet and a second outlet, the internal cavity being packed with a high frequency absorption material;

a pipe mounted within the internal cavity and extending from the second inlet to the second outlet along a pipe center axis that is offset from the housing center axis, and wherein the pipe includes at least one non-perforated pipe length located within the internal cavity;

an inter-pipe connecting the first outlet with the second inlet, wherein the inter-pipe comprises a sole exhaust gas flow path between the first outlet and the second inlet; and a passive valve mounted within the inter-pipe, the passive valve being mounted within the inter-pipe at a predetermined fixed distance from the second inlet of the second resonator.

2. The vehicle exhaust system according to claim 1 wherein the pipe comprises a single pipe that includes at least one perforated section located within the internal cavity and axially spaced from the non-perforated pipe length, and wherein the perforated section is in contact with the high frequency absorption material.

3. The vehicle exhaust system according to claim 2 wherein the single pipe defines a constant pipe diameter that extends from the second inlet to the second outlet, and wherein a remaining portion of the internal cavity not occupied by the single pipe is completely filled with the high frequency absorption material.

4. The vehicle exhaust system according to claim 3 wherein the predetermined fixed distance comprises four times the pipe diameter.

5. The vehicle exhaust system according to claim 2 wherein the perforated section extends along a predetermined length, and wherein the high absorption material is extends along a length of the pipe that is greater than the predetermined length such that the entire predetermined length is in contact with the high absorption material and at least a portion of the non-perforated pipe length is in contact with the high absorption material.

6. The vehicle exhaust system according to claim 5 wherein the high absorption material comprises a mat that is wrapped circumferentially around the single pipe leaving a portion of the internal cavity free from high absorption material.

7. The vehicle exhaust system according to claim 6 including a tuning tube connected to the non-perforated pipe length within the internal cavity.

8. The vehicle exhaust system according to claim 1 wherein the inter-pipe comprises a single tube body portion, and wherein the passive valve includes a vane that is mounted within the single tube body portion to move between a completely open position to provide maximum exhaust flow and a completely closed position where substantially all exhaust gas flow is blocked.

9. The vehicle exhaust system according to claim 1 wherein the passive valve includes a shaft rotatably supported on the single tube body and a resilient member that resiliently biases the vane to the closed position, and wherein the vane is fixed for rotation with the shaft such that when exhaust gas pressure exceeds a biasing force of the resilient member the vane pivots within the single tube body to move toward the open position.

10. A vehicle exhaust system comprising:

a first exhaust component having a first housing defining a first internal cavity, the first housing having a first inlet and a first outlet;

a second exhaust component positioned downstream of the first exhaust component, wherein the second exhaust component includes a second housing defining a second internal cavity, the second housing having a second inlet and a second outlet, the internal cavity being at least partially packed with a high frequency absorption material;

a pipe mounted within the second internal cavity and extending from the second inlet to the second outlet wherein the pipe includes at least one non-perforated pipe length located within the second internal cavity;

an inter-pipe connecting the first outlet with the second inlet, wherein the inter-pipe comprises a sole exhaust gas flow path between the first outlet and the second inlet; and a passive valve mounted within the inter-pipe at a predetermined fixed distance from one of the first outlet of the first exhaust component and the second inlet of the second exhaust component, and wherein the inter-pipe comprises a single tube body portion, and wherein the passive valve includes a vane that is mounted within the single tube body portion to move between a completely open position to provide maximum exhaust flow and a completely closed position where substantially all exhaust gas flow is blocked.

11. The vehicle exhaust system according to claim 10 wherein the passive valve is positioned immediately adjacent to the first outlet.

12. The vehicle exhaust system according to claim 10 wherein the pipe comprises a single pipe that extends from the second inlet to the second outlet, the single pipe including at least one perforated section located within the second internal cavity and axially spaced from the non-perforated pipe length, and wherein the perforated section is in contact with the high frequency absorption material.

13. The vehicle exhaust system according to claim 12 wherein the second internal cavity is completely packed with the high frequency absorption material.

14. The vehicle exhaust system according to claim 12 wherein the high frequency absorption material comprises a mat that is wrapped around the perforated section leaving a portion of the second internal cavity free from high frequency absorption material.

15. The vehicle exhaust system according to claim 12 wherein the single pipe defines a constant pipe diameter that extends from the second inlet to the second outlet, and wherein the predetermined fixed distance comprises four times the pipe diameter.

16. The vehicle exhaust system according to claim 10 wherein the non-perforated pipe length extends from the second inlet to the second outlet.

17. The vehicle exhaust system according to claim 10 wherein the high frequency absorption material surrounds at least a portion of the non-perforated pipe length within the second internal cavity.

18. The vehicle exhaust system according to claim 10 wherein the pipe defines an overall pipe length extending from the second inlet to the second outlet, and wherein the pipe includes at least one perforated pipe length, and wherein the at least one non-perforated pipe length comprises a first non-perforated pipe length that is upstream of the perforated pipe length and a second non-perforated pipe length that is downstream of the perforated pipe length, wherein the first and second non-perforated pipe lengths added to the perforated pipe length is substantially equal to the overall pipe length.

19. The vehicle exhaust system according to claim 18 wherein the perforated pipe length is completely covered by the high absorption material.

20. The vehicle exhaust system according to claim 19 wherein at least portions of the first and second non-perforated pipe lengths are surrounded by the high frequency absorption material.

21. The vehicle exhaust system according to claim 20 wherein a portion of the second internal cavity is unoccupied by the high frequency absorption material.

22. The vehicle exhaust system according to claim 10 wherein the first and second exhaust components respectively comprise first and second mufflers.

23. The vehicle exhaust system according to claim 12 including a tuning tube connected to the non-perforated pipe length within the internal cavity and axially spaced apart from the perforated section.

24. The vehicle exhaust system according to claim 10 wherein the second housing extends from a first housing end to second housing end to define a housing center axis, and the second housing defining a single chamber, and wherein the pipe comprise a single pipe that extends along a pipe center axis that is offset from the housing center axis.

25. The vehicle exhaust system according to claim 10 wherein the passive valve includes a shaft rotatably supported on the single tube body and a resilient member that resiliently biases the vane to the closed position, and wherein the vane is fixed for rotation with the shaft such that when exhaust gas pressure exceeds a biasing force of the resilient member the vane pivots within the single tube body to move toward the open position.

26. The vehicle exhaust system according to claim 25 wherein the single tube body has the same cross-sectional area immediately upstream and downstream of the vane.

27. The vehicle exhaust system according to claim 9 wherein the single tube body has the same outer diameter immediately upstream and downstream of the vane.

* * * * *